US006681458B2

(12) United States Patent
Seymour

(10) Patent No.: US 6,681,458 B2
(45) Date of Patent: Jan. 27, 2004

(54) SPRING CLIP

(75) Inventor: Kenneth R. Seymour, Villa Park, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 86 days.

(21) Appl. No.: 09/921,036

(22) Filed: Aug. 2, 2001

(65) Prior Publication Data

US 2003/0024082 A1 Feb. 6, 2003

(51) Int. Cl.[7] ..... H01R 13/639

(52) U.S. Cl. ..... 24/675; 24/634; 285/305; 285/319

(58) Field of Search ..... 24/671, 634, 673–676, 24/635; 403/326–329; 285/305, 319–321; 439/350, 353, 354, 357, 358; 123/469, 470

(56) References Cited

U.S. PATENT DOCUMENTS

| | | | | | |
|---|---|---|---|---|---|
| 2,194,769 | A | * | 3/1940 | Reed | 439/358 |
| 3,544,951 | A | * | 12/1970 | Roberts | 439/358 |
| 3,602,009 | A | * | 8/1971 | Powell | |
| 3,753,582 | A | * | 8/1973 | Graham | |
| 3,842,959 | A | * | 10/1974 | Bauer | |
| 4,225,206 | A | * | 9/1980 | Roman, Jr. | |
| 4,564,252 | A | * | 1/1986 | Kato et al. | 439/348 |
| 4,900,271 | A | * | 2/1990 | Colleran et al. | |
| 4,961,711 | A | * | 10/1990 | Fujira et al. | |
| 5,129,834 | A | * | 7/1992 | Cranford | |
| 5,360,237 | A | * | 11/1994 | Carman et al. | |
| 5,501,195 | A | * | 3/1996 | Hall | 123/470 |
| 5,562,477 | A | * | 10/1996 | Moore et al. | |
| 5,607,315 | A | * | 3/1997 | Bonnah, II et al. | |
| 6,012,945 | A | * | 1/2000 | Tabor et al. | |
| 6,059,598 | A | * | 5/2000 | Yamashita et al. | |
| 6,132,234 | A | * | 10/2000 | Waidner et al. | 439/358 |

FOREIGN PATENT DOCUMENTS

| | | | | |
|---|---|---|---|---|
| DE | 3150424 | A | * 12/1982 | H01R/13/63 |
| DE | 3725261 | A | * 2/1989 | H01R/13/63 |
| DE | 3804107 | A | * 8/1989 | H01R/13/63 |
| DE | 4030075 | A | * 3/1992 | H01R/13/62 |
| EP | 603033 | A1 | * 6/1994 | F16L/37/133 |
| EP | 669678 | A1 | * 8/1995 | H01R/13/11 |
| FR | 2772996 | A1 | * 6/1999 | H01R/13/639 |
| GB | 2075769 | A | * 11/1981 | H01R/13/00 |

OTHER PUBLICATIONS

"CLC 4 Plug," Clip Lock Circular Connector, ITT Industries.

* cited by examiner

*Primary Examiner*—James R. Brittain
(74) *Attorney, Agent, or Firm*—Dennis Kelly Sullivan; Susan L. Lukasik; Jeffrey P. Calfa

(57) ABSTRACT

A spring clip for retaining an electrical connector in coupled engagement with a fuel injector includes a unitary spring clip component having a retainer assembly, a lever assembly operably coupled to the retainer assembly, and a fulcrum assembly operably coupled to the lever assembly. A method of disengaging a spring clip from engagement with a fuel injector, the spring clip retaining an electrical connector in coupled engagement with the fuel injector is also included.

15 Claims, 8 Drawing Sheets

SPRING CLIP

TECHNICAL FIELD

The present invention is a spring clip utilized as a retainer. More particularly, the present invention is a spring clip used for retaining a quick release electrical connector to a fuel injector.

BACKGROUND OF THE INVENTION

Designs of internal combustion engines become ever more complex as designers seek to enhance engine performance while at the same time providing an environmentally responsible engine. This complexity seeks to place an ever-increasing number of devices in an ever-decreasing amount of space. In a particular application, a new advanced Vee-type engine places an electrical connector in a very reduced and relatively inaccessible volume of space. The ability for service personnel to disengage a spring clip in order to release the electrical connector from a fuel injector for performing service on the fuel injector is greatly compromised.

There is then a need in the industry to provide a spring clip for retaining an electrical connector to a fuel injector that is readily disengagable by service personnel for releasing the electrical connector from the fuel injector.

SUMMARY OF THE INVENTION

The spring clip of the present invention substantially meets the aforementioned needs of the industry. The spring clip is disposed proximate the end of the electrical connector that is in engagement with the fuel injector. The closer that a service person has to get his thumb or a tool to the fuel injector in order to disengage the spring clip, the more restricted is the space available. The spring clip of the present invention allows disengagement of the spring clip while keeping the thumb at a substantial distance from the retainer assembly portion of the spring clip. Further, by including a fulcrum assembly that bears on the barrel of the electrical connector, increased leverage is available with simple pressure in order to disengage the spring clip. In an alternative embodiment, a resilient sleeve is overmolded on the lever assembly of the spring clip in order to provide a relatively comfortable surface for the thumbs of the service personnel to bear on.

The present invention is a spring clip for retaining an electrical connector in coupled engagement with a fuel injector includes a unitary spring clip component having a retainer assembly, a lever assembly operably coupled to the retainer assembly, and a fulcrum assembly operably coupled to the lever assembly. The present invention is further a method of disengaging a spring clip from engagement with a fuel injector, the spring clip retaining an electrical connector in coupled engagement with the fuel injector.

BRIEF DESCRIPTION OF THE PREFERRED EMBODIMENT

Figure 1:
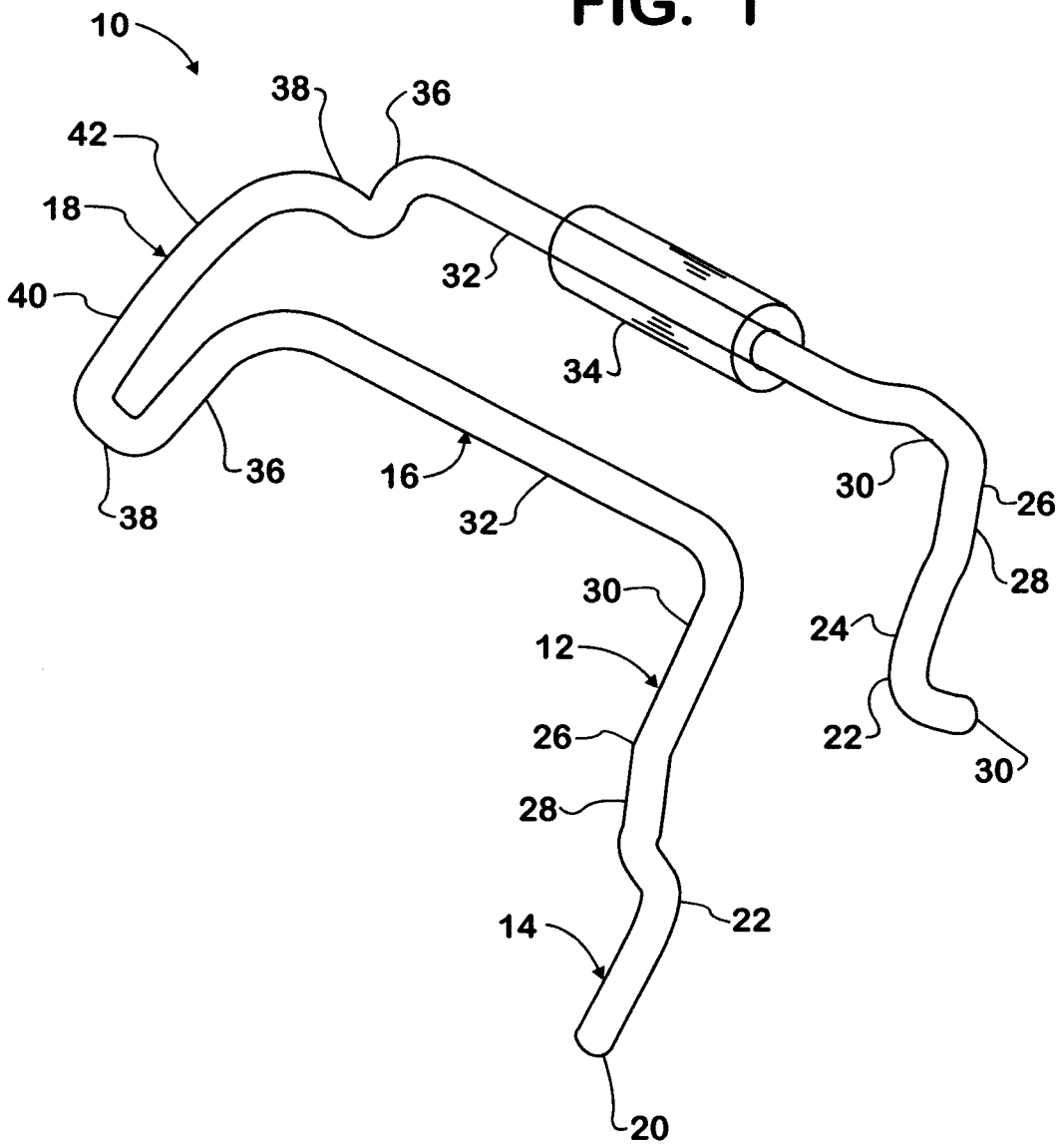
FIG. 1 is a perspective view of the spring clip of the present invention.
Figure 2:
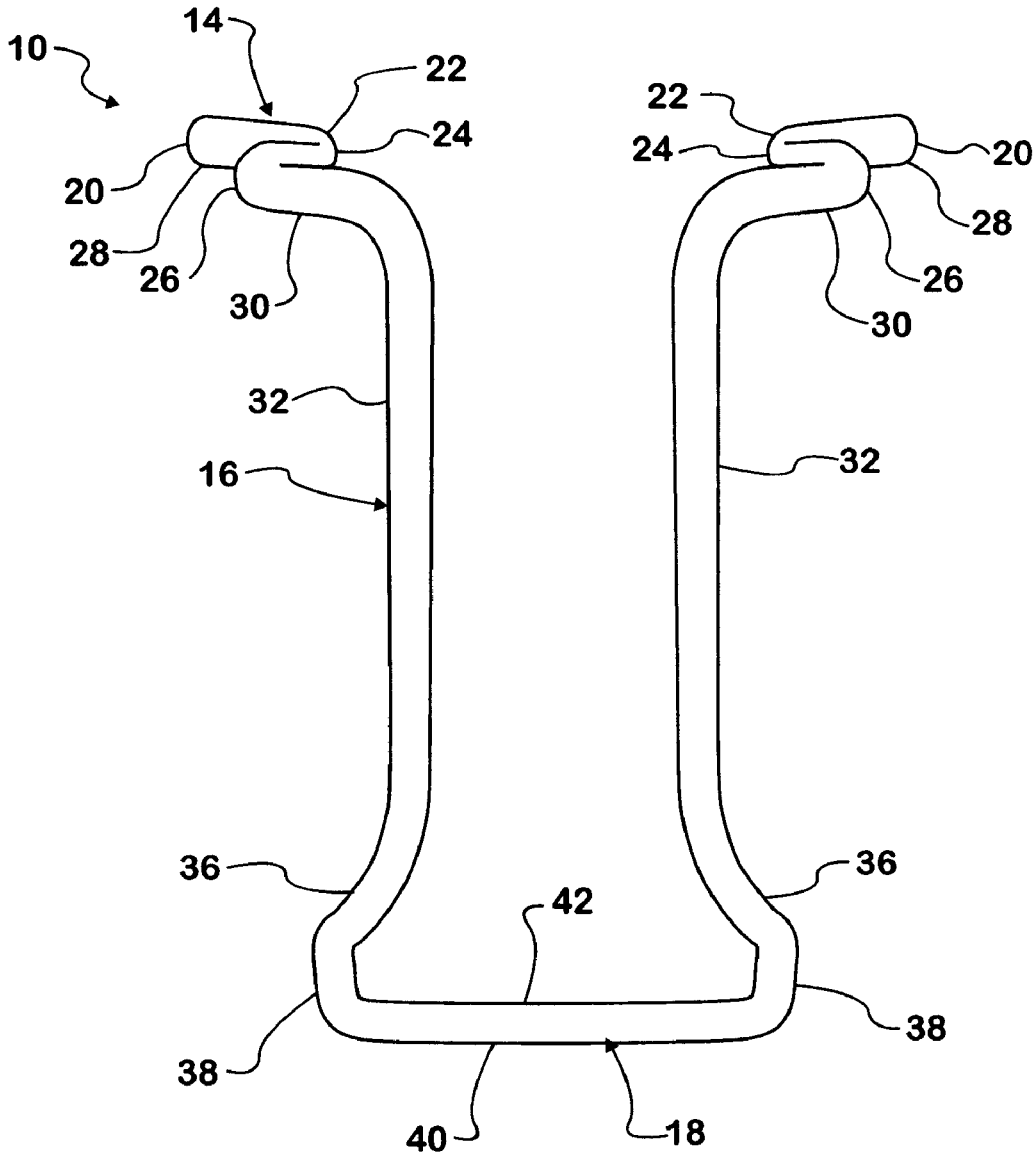
FIG. 2 is a side elevational view of the spring clip of the present invention.
Figure 3:
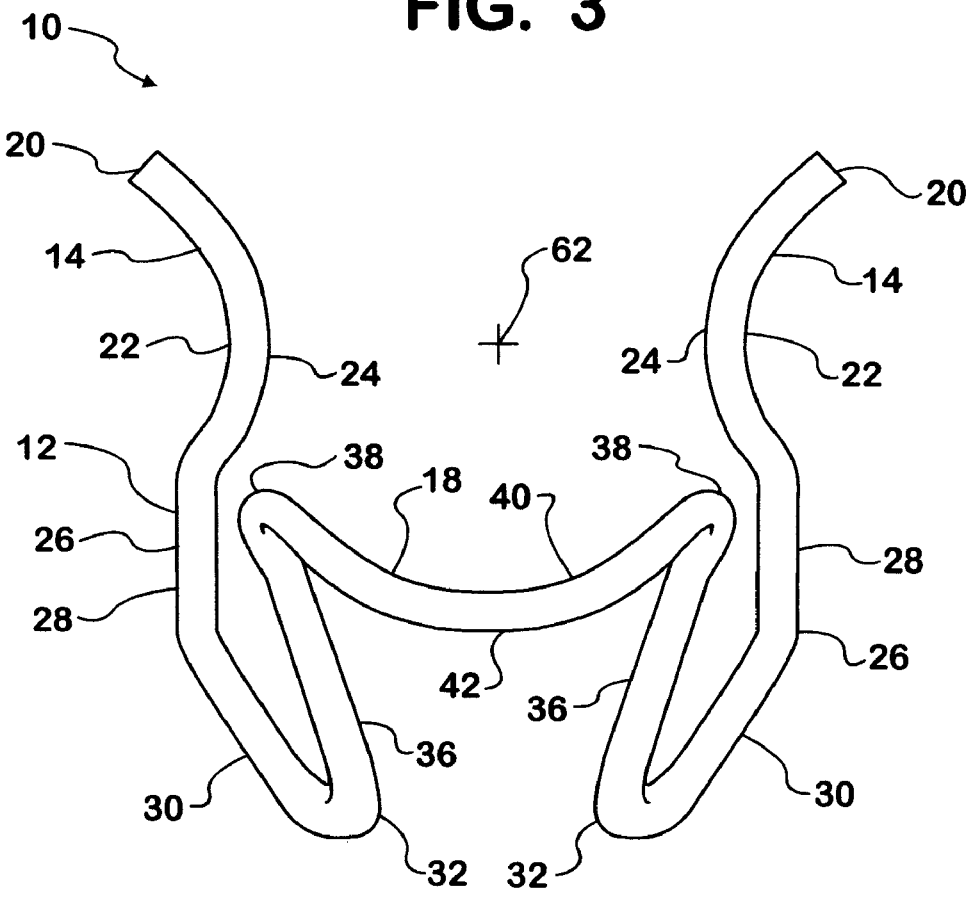
FIG. 3 is a bottom plan form view of the spring clip viewed from the fulcrum assembly end of the spring clip.
Figure 4:
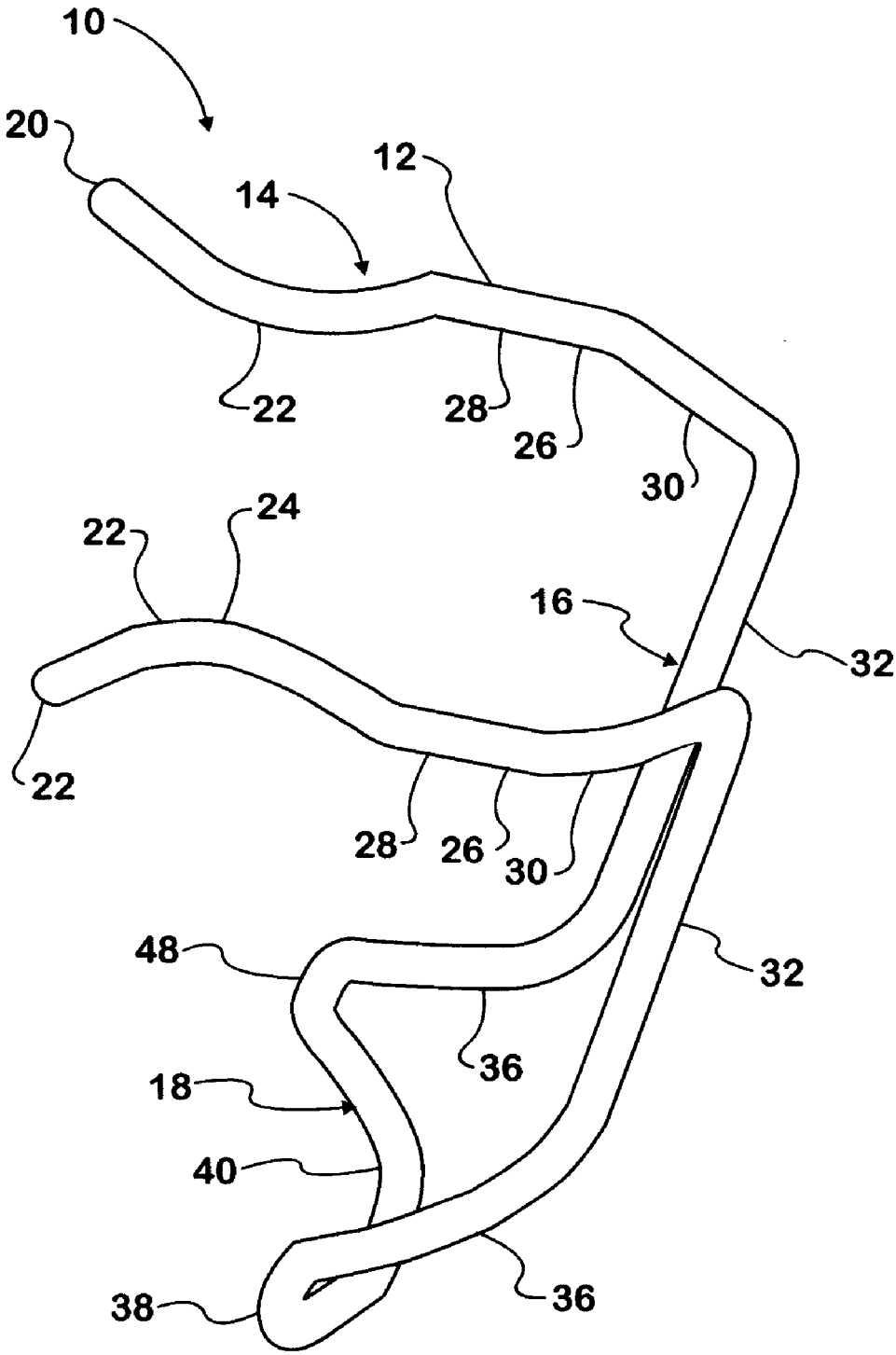
FIG. 4 is a perspective view of the spring clip.

The spring clip of the present invention is shown generally at 10 in FIGS. 1–4 and in cooperative engagement with a representative electrical connector 50 in FIGS. 5–8.

Turning to FIGS. 1–4, the spring clip 10 is formed of a continuous strand of wire 12. This spring clip 10 has a bias in the shape noted in the various figures and resists being moved out of that shape. The spring clip 10 tends to assume the noted shape, absent a force acting to deform it. The wire 12 is shaped to form the major components of the spring clip 10 comprising a retainer assembly 14, a lever assembly 16, and a fulcrum assembly 18.

It should be noted that the spring clip 10 has two substantially mirror image halves centered on a center point of the fulcrum assembly 18, as will be described in more detail below. Descriptions of component apply to each half of the spring clip 10.

The first component of the spring clip 10 is the retainer assembly 14. The retainer assembly 14 has two outward flared ends 20. The flared ends 20 are formed continuous with semi-circular engaging members 22. Engaging members 22 have an inward directed engaging margin 24 compressively for engaging a portion of a fuel injector and retaining an electrical connector to the fuel injector, as will be described in more detail below.

A spacing member 26 is formed continuous with each of the engaging members 22. The spacing member 26 has first parallel portions 28, connected to an inward directed portion 30.

The second component of the spring clip 10 is the lever assembly 16. The lever assembly 16 is comprised of a pair of elongate shanks 32, an elongate shank 32 being formed continuous with each one of the spacing members 26. The elongate shank 32 depends from the spacing member 26 in a substantially orthogonal relationship therewith. The shanks 32 are spaced apart from one another and are disposed substantially parallel to one another.

In an alternative embodiment, an overmold 34, depicted on a selected elongate shank 32 in FIG. 1 may be applied to each of the elongate shanks 32. The overmold 34 is preferably formed of a resilient material for providing a relatively comfortable surface on which a service person may apply thumb pressure to the spring clip 10.

The third component of the spring clip 10 is the fulcrum assembly 18. The fulcrum assembly 18 is formed continuous with the distal ends of the respective elongate shanks 32. The fulcrum assembly 18 includes an outward directed curved section 36 that is coupled to each of the elongate shanks 32. Each of the curved sections 36 terminates in a U-shaped connector section 38. Each of the U-shaped connector sections 38 is coupled to a respective end of the curved fulcrum section 40. The curved fulcrum section 40 has a radius that is designed to make the curved fulcrum section 40 conform substantially to the outer margin of a barrel portion of an electrical connector, such as the exemplary electrical connector discussed below.

Turning to FIGS. 5–8, the spring clip 10 is shown in engagement with an electrical connector 50. The electrical connector 50 has a lead connector 52 that is connectable to electrical leads from an engine control system or the like (see leads 72 depicted schematically in FIG. 8). The body of the electrical connector 50 defines a barrel 54 having a generally cylindrical exterior margin.

A receiver 55 is formed at the distal end of the barrel 54. The receiver 55 has an increased diameter as compared to the diameter of the barrel 54 and has an interior aperture (not shown) defined therein for receiving a portion of a fuel injector.

Figure 7:
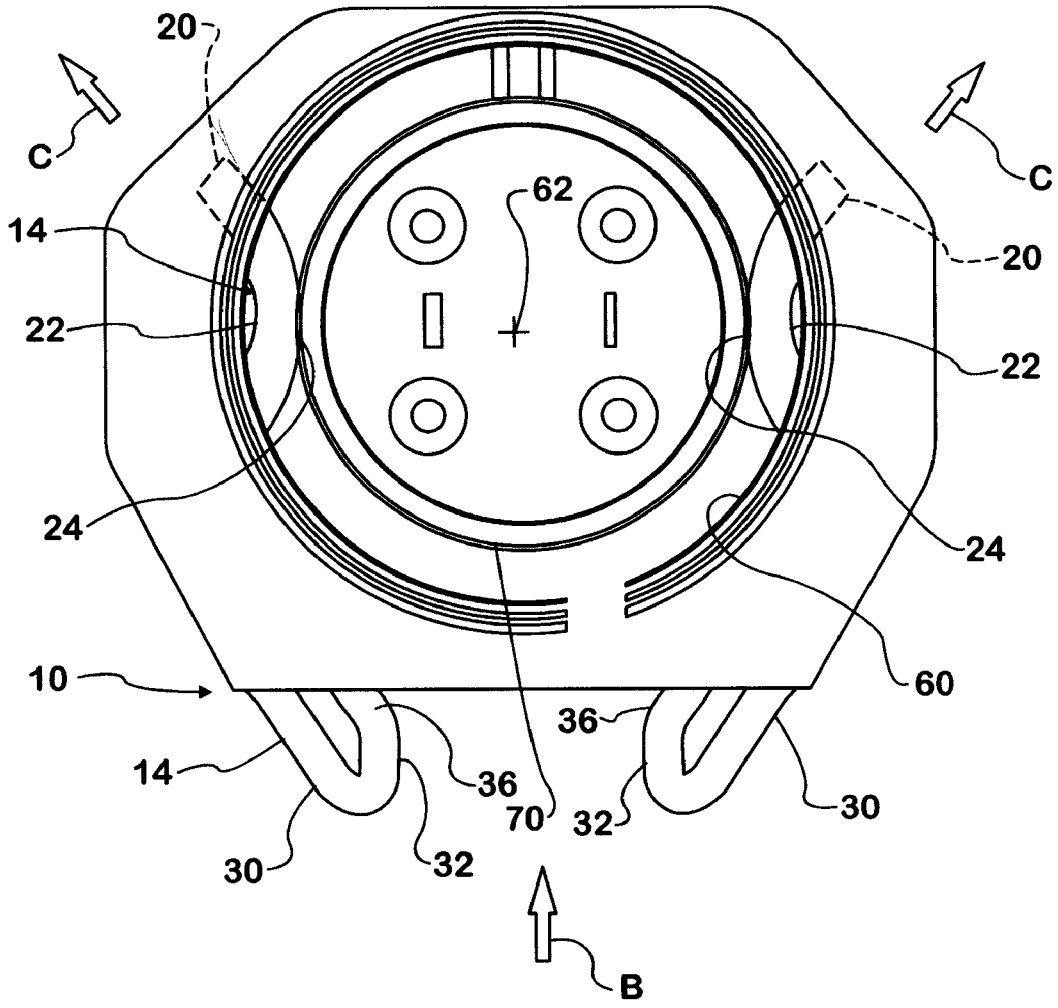
FIG. 7 is a sectional view taken along the section line 7—7 of FIG. 6.

A pair of clip guides 56 are formed at the distal end of the receiver 55. The clip guides 56 are spaced apart and define a clip slot 58 there between. The clip slot 58 has a width dimension that is slightly greater than the diameter of the spring clip 10. As depicted in FIG. 7, at least a portion of the inner margin of the clip slot 58 is open to define a pair of semi-circular circumferential slots 60 through which the semi-circular engaging members 22 of the retainer assembly 14 may project to compressibly engage a fuel injector 70.

Figure 5:
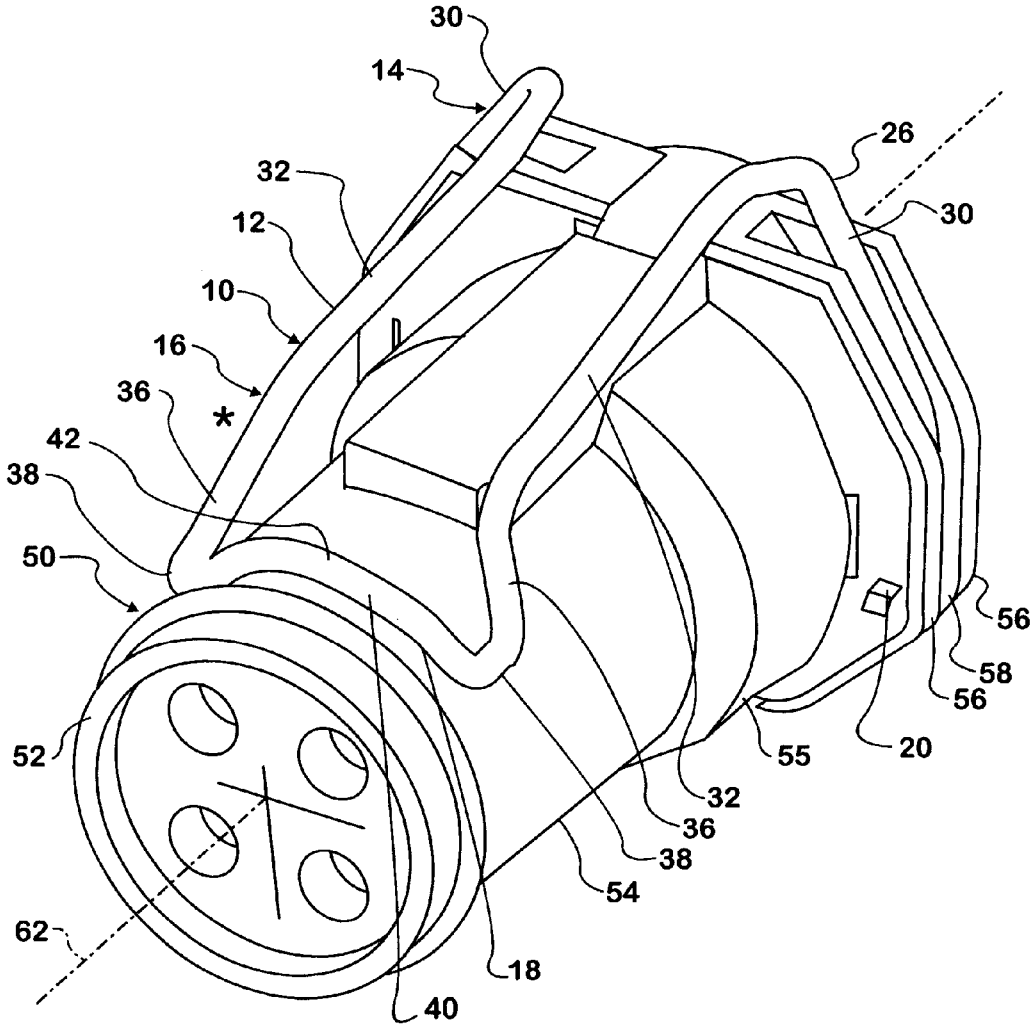
FIG. 5 is a perspective view of the spring clip in engagement with a representative electrical connector.
Figure 6:
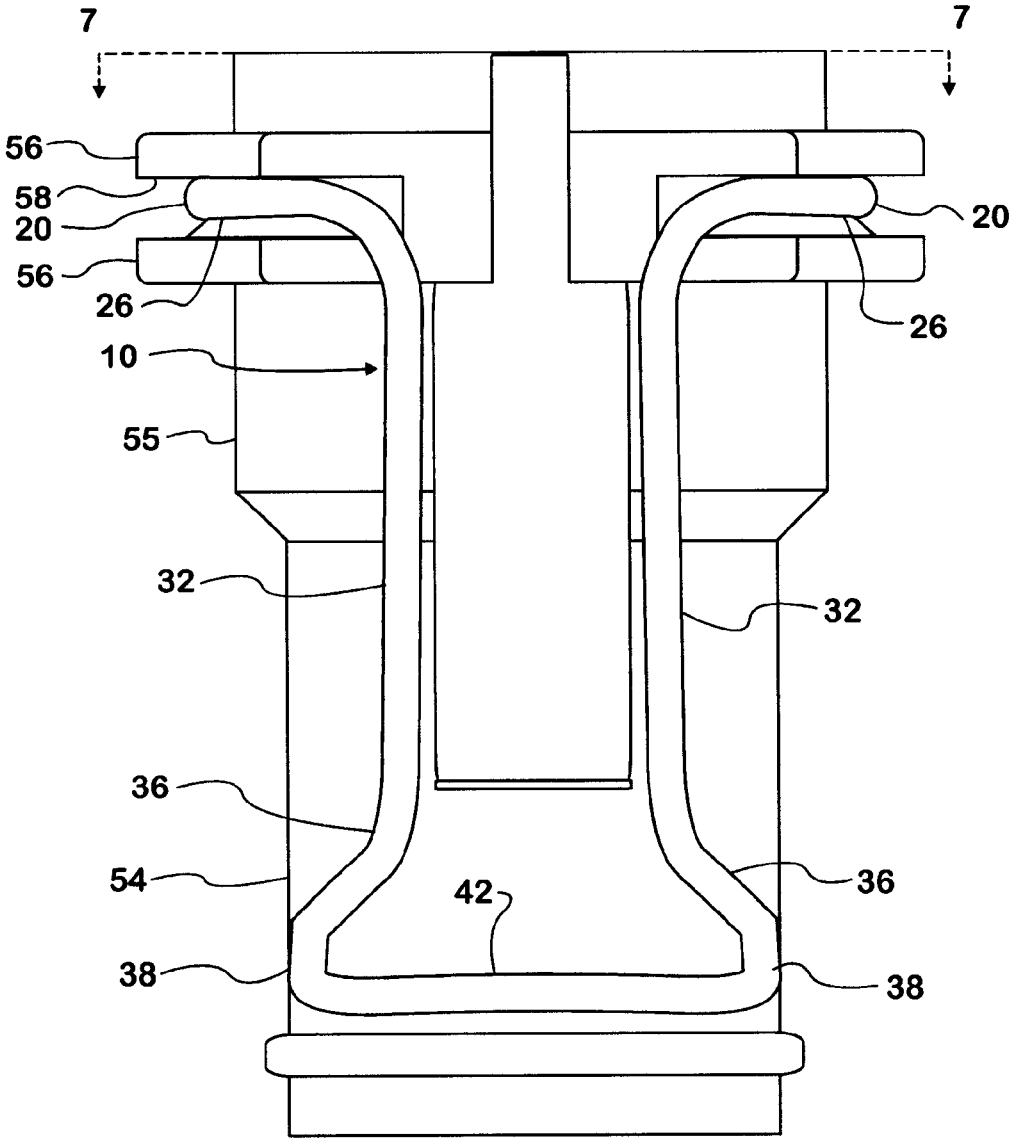
FIG. 6 is a side elevational view of the spring clip in engagement with the electrical connector.

As depicted in FIG. 5, the electrical connector 50 has a longitudinal axis 62. A plane defined by the longitudinal axis 60 and a line parallel to the longitudinal axis 60 and passing through the center 42 of the curved fulcrum section 40 bisects the spring clip 10 into the aforementioned mirror image halves of the spring clip 10.

In assembly, the spring clip 10 is designed to be an integral part of the electrical connector 50 and be retained on the electrical connector 50, even when the electrical connector 50 is disengaged from the fuel injector 70. To this end, to initially mate the spring clip 10 to the electrical connector 50, pressure is exerted on the lever assembly 16 normal to the axis 60 as indicated by Arrow A of FIG. 8. Such pressure causes the outward flared ends 20 to ride over the initial portions of the clip slot 58, thereby spreading the respective outward flared ends 20 with respect to one another. Continued pressure as indicated at Arrow A causes the two semi-circular engaging members 22 to ride over the initial portions of the clip slot 58 and to pass through the circumferential slots 60 as depicted in FIG. 7. Note that the spacing members 26 hold the shanks 32 spaced apart from the barrel 54 and the fulcrum section 40 conforms to the exterior margin of the barrel 54 and is in compressive engagement therewith. In this configuration, the electrical connector 50 is configured to be electrically coupled to the injector 70.

Figure 8:
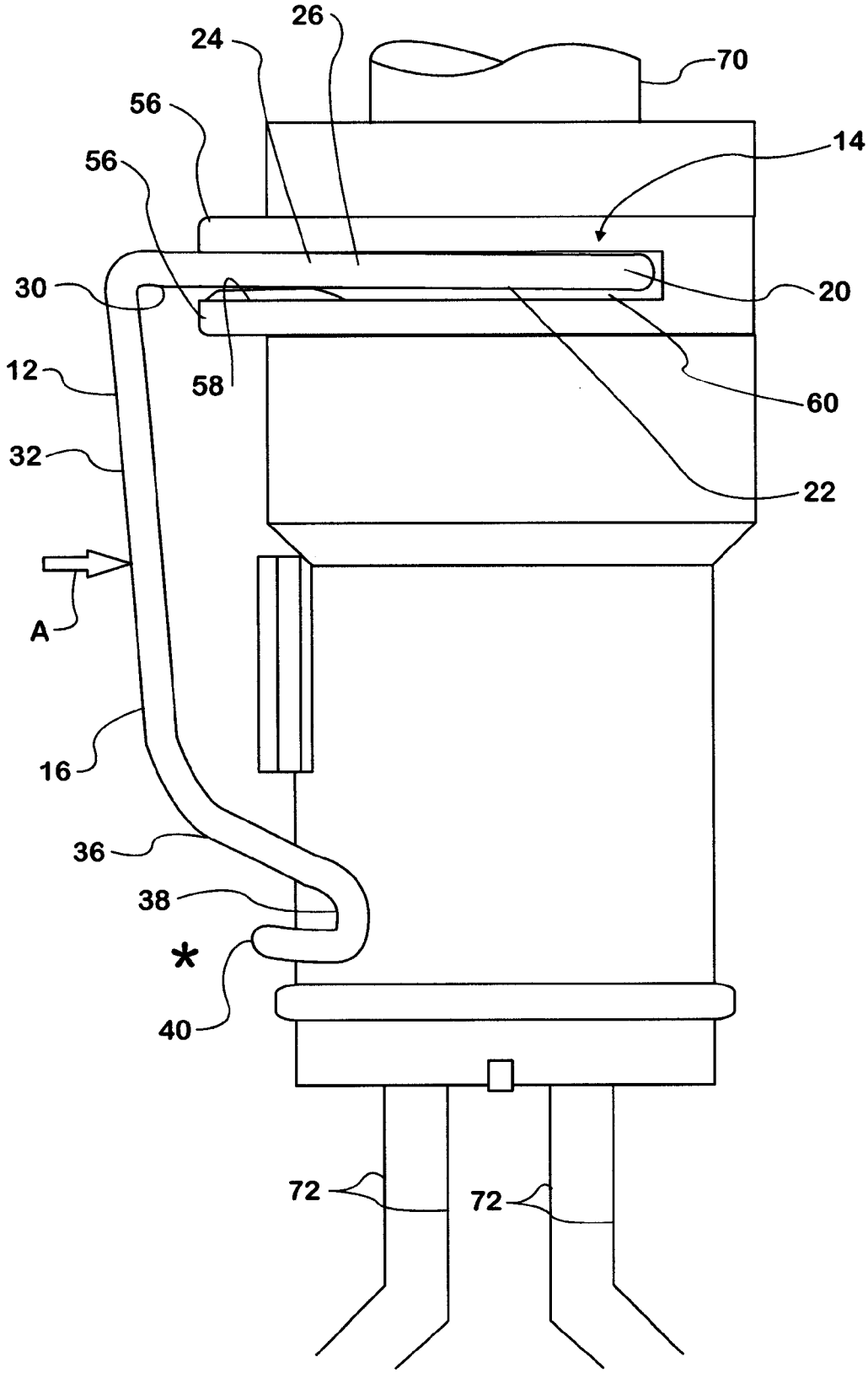
FIG. 8 is a side elevational view of the spring clip engaged with the electrical connector.

To effect the coupling of the electrical connector 50 to the injector 70, normal pressure is again applied to the lever assembly 16 as indicated by the Arrow A in FIG. 8. Such pressure results in translation of the retainer assembly 14 in the direction indicated by Arrow B of FIG. 7 normal to axis 60 and displacing the shanks 32 to a disposition closer to the barrel 54. Such translation results in translation of the semi-circular engaging members 22 as indicated by the Arrows C. As depicted in FIG. 7, the Arrows C depict both an upward and outward motion. This is achieved by the outward flared ends 20 riding on a closed portion adjacent to the circumferential slot 60, thereby increasing the distance between the respective outward flared ends 20. This results in increasing the inward directed spring tension that exists between the flared ends 20. Further, this results resulting in spreading the engaging margin 24 of the semi-circular engaging members 22 and disengaging the engaging members 22 from the injector 70. In such disposition, the electrical connector 50 may be slid over the injector 70, a portion of the injector 70 being received within the aperture defined in the receiver 55 of the electrical connector 50. Once in place, pressure as indicated by Arrow A is released and the two semi-circular engaging members 22 retreat under the impetus of the inward directed spring bias in directions opposite to that as indicated by Arrows C to compressibly engage the injector 70 as depicted in FIG. 7.

Disengagement of the electrical connector 50 from the injector 70 is effective in precisely the same way, normal pressure is exerted as indicated by Arrow A in FIG. 8 to effect translation of the retainer assembly 14 as indicated by the Arrows B and C once the semi-circular engaging members 22 are disengaged from the injector 70, the electrical connector 50 may be pulled free of the injector 70, the injector 70 being slid free of the receiver 55 of the electrical connector 50.

It will be obvious to those skilled in the art that other embodiments in addition to the ones described herein are indicated to be within the scope and breadth of the present application. Accordingly, the applicant intends to be limited only by the claims appended hereto.

What is claimed is:

1. A unitary, integral spring clip for mating with an electrical connector in coupled engagement therewith, the electrical connector having a connector body, comprising:

a retainer assembly being couplably engageable with the electrical connector at a first spring clip end; and a lever assembly operably coupled to the retainer assembly, the lever assembly having a pair of spaced apart shanks, said shanks terminating respectively in intersections with a lateral extending fulcrum assembly bearable on said connector body without being retained by connector body structure at a second spring clip end spaced apart from the first spring clip end, the fulcrum assembly acting to space the shanks from the connector body, the respective intersections being disposed laterally, externally to the electrical connector body.

2. The spring clip of claim 1 where a certain force component exerted on the lever assembly in cooperation with the fulcrum assembly bearing on the electrical connector acts to impart a motion to the retainer assembly displacing the retainer assembly from an engaged disposition to a disengaged disposition.

3. The spring clip of claim 2 wherein the force component is exerted substantially normal to the lever assembly and directed toward the electrical connector.

4. The spring clip of claim 1 being operably coupled to the electrical connector, motion of the fulcrum assembly in a selected direction being restrained by the electrical connector and the retainer assembly being translatable relative to the electrical connector in the selected direction.

5. The spring clip of claim 4 whereby a component of a certain force exerted on the lever assembly in the selected direction acts to translate the retainer assembly relative to the electrical connector.

6. The spring clip of claim 5 wherein the component of the force is exerted substantially normal to the lever assembly and directed substantially transverse to an electrical connector longitudinal axis.

7. A spring clip for retaining an electrical connector in coupled engagement with a fuel injector, comprising:

a unitary spring clip component having:

a retainer assembly disposed at a first end of the spring clip;

a lever assembly operably coupled to the retainer assembly and having a pair of spaced apart shanks, said shanks terminating respectively in fulcrum intersections with a laterally extending fulcrum assembly; and the fulcrum assembly disposed at a second end of the clip and being operably coupled to the lever assembly and formed to bear on an external margin, the fulcrum assembly restraining motion of the second end of the spring clip by means of the fulcrum assembly being in a bearing engagement with the external margin without retention thereby, the fulcrum intersections acting to space the shanks from the external margins, the respective fulcrum intersections disposed laterally, external to the external margin.

8. The spring clip of claim 7, the fulcrum assembly being curved to conform to an external margin curve.

9. The spring clip of claim 8 wherein the fulcrum assembly operably unitarily couples two halves of the spring clip.

10. The spring clip of claim 7, the retainer assembly having first and second spaced apart flared distal ends.

11. The spring clip of claim 10 having first and second curved engaging members operably coupled to a respective one of the first and second flared distal ends.

12. The spring clip of claim 11, the first and second engaging members being opposed and each having an inward directed engaging margin for compressively engaging an object disposed between the first and second engaging members.

13. The spring clip of claim 10, the retainer assembly having first and second spacing members, the spacing members being operably coupled to the lever assembly for displacing the lever assembly from the electrical connector.

14. The spring clip of claim 7, the lever assembly having a pair of spaced apart elongate shanks being disposed in a depending, less than orthogonal relationship to the retainer assembly.

15. The spring clip of claim 14 including an overmolding of a resilient material being disposed on at least one of the shanks.

* * * * *